US010161343B2

(12) United States Patent
Aoki et al.

(10) Patent No.: US 10,161,343 B2
(45) **Date of Patent: *Dec. 25, 2018**

(54) CORRECTION DEVICE FOR AIR/FUEL RATIO SENSOR

(71) Applicant: TOYOTA JIDOSHA KABUSHIKI KAISHA, Toyota-shi, Aichi-ken (JP)

(72) Inventors: Keiichiro Aoki, Sunto-gun (JP); Takanori Sasaki, Susono (JP); Go Hayashita, Susono (JP)

(73) Assignee: TOYOTA JIDOSHA KABUSHIKI KAISHA, Aichi-ken (JP)

( * ) Notice: Subject to any disclaimer, the term of this patent is extended or adjusted under 35 U.S.C. 154(b) by 289 days.

This patent is subject to a terminal disclaimer.

(21) Appl. No.: 15/133,310

(22) Filed: Apr. 20, 2016

(65) Prior Publication Data

US 2016/0230690 A1 Aug. 11, 2016

Related U.S. Application Data

(63) Continuation of application No. 14/114,770, filed as application No. PCT/JP2011/061532 on May 19, 2011, now Pat. No. 9,347,352.

(51) Int. Cl.
*F01N 3/00* (2006.01)
*F02D 41/24* (2006.01)
(Continued)

(52) U.S. Cl.
CPC ..... *F02D 41/2474* (2013.01); *F01N 3/18* (2013.01); *F02D 41/0235* (2013.01);
(Continued)

(58) Field of Classification Search
CPC ..... F02D 41/2474; F02D 41/0235; F02D 41/1441; F02D 41/1456; F02D 41/2438; F02D 41/2454; F02D 41/2441; F01N 3/18
(Continued)

(56) References Cited

U.S. PATENT DOCUMENTS

| | | | | |
|---|---|---|---|---|
| 5,251,437 | A | 10/1993 | Furuya | |
| 9,347,352 | B2 * | 5/2016 | Aoki | F02D 41/0235 |
| 2001/0045089 | A1 | 11/2001 | Kobayashi et al. | |
| 2003/0017603 | A1 | 1/2003 | Uchida et al. | |

(Continued)

FOREIGN PATENT DOCUMENTS

| | | | |
|---|---|---|---|
| EP | 0534371 | A2 | 3/1993 |
| JP | 6-280662 | A | 10/1994 |

(Continued)

*Primary Examiner* — Phutthiwat Wongwian
*Assistant Examiner* — Kelsey Stanek
(74) *Attorney, Agent, or Firm* — Sughrue Mion, PLLC

(57) ABSTRACT

A correction device for an air/fuel ratio sensor in the present invention, the sensor issuing an output according to an air/fuel ratio and installed on the downstream from catalyst of the exhaust passage, has air/fuel ratio control means for controlling an air/fuel ratio of an exhaust gas on the upstream side from a catalyst to switch between a rich air/fuel ratio which is richer and a lean air/fuel ratio which is leaner than a stoichiometric air/fuel ratio. Moreover, correction means for correcting an output of the sensor in accordance with a difference between the output of the sensor during a predetermined period during air/fuel ratio control by the air/fuel ratio control means, and a reference output corresponding to a stoichiometric air/fuel ratio, is provided.

9 Claims, 2 Drawing Sheets

(51) Int. Cl.
*F02D 41/02* (2006.01)
*F02D 41/14* (2006.01)
*F01N 3/18* (2006.01)

(52) U.S. Cl.
CPC ..... *F02D 41/1441* (2013.01); *F02D 41/1456* (2013.01); *F02D 41/2438* (2013.01); *F02D 41/2454* (2013.01); *F02D 41/2441* (2013.01)

(58) Field of Classification Search
USPC ..... 60/285; 701/103, 104
See application file for complete search history.

(56) References Cited

U.S. PATENT DOCUMENTS

| | | | | |
|---|---|---|---|---|
| 2006/0190159 | A1 | 8/2006 | Iihoshi et al. | |
| 2007/0250230 | A1 | 10/2007 | Iihoshi et al. | |
| 2008/0066727 | A1 | 3/2008 | Kato et al. | |
| 2008/0307852 | A1 | 12/2008 | Rodatz et al. | |
| 2009/0019834 | A1* | 1/2009 | Aoki ..... | F01N 3/0807 60/277 |

FOREIGN PATENT DOCUMENTS

| | | | |
|---|---|---|---|
| JP | 9-79072 | A | 3/1997 |
| JP | 9-125938 | A | 5/1997 |
| JP | 10-169500 | A | 6/1998 |
| JP | 2003-97334 | A | 4/2003 |
| JP | 2005-120870 | A | 5/2005 |
| JP | 2006-2579 | A | 1/2006 |
| JP | 2006-233831 | A | 9/2006 |
| JP | 2008-75495 | A | 4/2008 |
| JP | 2011-58364 | A | 3/2011 |

* cited by examiner

CORRECTION DEVICE FOR AIR/FUEL RATIO SENSOR

CROSS-REFERENCE TO RELATED APPLICATIONS

This application is a continuation of U.S. application Ser. No. 14/114,770 filed Oct. 30, 2013, which is a U.S. National Stage of International Application No. PCT/JP2011/061532 filed May 19, 2011. The entire disclosures of the prior applications are considered part of the disclosure of the accompanying continuation, and are hereby incorporated by reference.

TECHNICAL FIELD

The present invention relates to a correction device for an air/fuel ratio sensor. More specifically, the present invention relates to a correction device for correcting an output of an air/fuel ratio sensor installed on the downstream of a catalyst of an exhaust passage of an internal combustion engine.

BACKGROUND ART

For example, Patent Literature 1 discloses a catalyst deterioration detecting device for an internal combustion engine. In this catalyst deterioration detecting device, an air/fuel ratio sensor is installed on the upstream of the catalyst, while an electromotive force-type oxygen sensor is installed on the downstream. In deterioration detection of a catalyst by this catalyst deterioration detecting device, an air/fuel ratio on the upstream of the catalyst is forcedly controlled so as to fluctuate between a predetermined rich air/fuel ratio and a lean air/fuel ratio. Then, a temporal value until output of the oxygen sensor on the downstream side changes from a lean output to a rich output or a temporal value until a lean output is detected from a rich output is detected in this control. In this deterioration detection of the catalyst, an oxygen storage capacity of the catalyst is calculated on the basis of such temporal value, and moreover, deterioration of the catalyst is determined on the basis of whether the calculated oxygen storage capacity is larger than a predetermined value or not.

CITATION LIST

Patent Literature

Patent Literature 1: Japanese Patent Laid-Open No. 2003-097334

Patent Literature 2: Japanese Patent Laid-Open No. 2006-002579

Patent Literature 3: Japanese Patent Laid-Open No. 2005-120870

Patent Literature 4: Japanese Patent Laid-Open No. 6-280662

Problem to be Solved by Invention

An electromotive force-type oxygen sensor largely depends on an amount of a gas or concentration of a gas to be detected and has a feature that it is difficult to obtain an output for a gas with low concentration or a low flow rate. Therefore, if concentration of an exhaust gas exhausted to the downstream of the catalyst becomes further lower due to stricter regulation of exhaust gas or the like, it is concerned that the electromotive force-type oxygen sensor cannot accurately detect a change in the air/fuel ratio on the downstream of the catalyst any longer.

Moreover, the lower the concentration of the gas to be detected becomes, the more output response of the oxygen sensor tends to be delayed. Therefore, in the low-concentration exhaust gas environment, it becomes difficult to detect a change in the air/fuel ratio between a rich air/fuel ratio and a lean air/fuel ratio immediately upon fluctuation. Therefore, it is considered to become difficult to maintain control accuracy high on the basis of an output change of the oxygen sensor on the downstream side such as catalyst deterioration detection as the above described prior-art technology.

In response to that, as a sensor on the catalyst downstream side, a limiting-current type air/fuel ratio sensor, for example, can be employed. With the limiting-current type air/fuel ratio sensor, an air/fuel ratio of an exhaust gas with extremely low concentration can be detected accurately to some degree. However, in the air/fuel ratio sensor, too, its output might be shifted due to deterioration over time, initial variation and the like. In such cases, it is difficult to maintain high accuracy in control such as catalyst deterioration determination or the like due to an output error of the air/fuel ratio sensor.

As described above, the present invention has an object to solve the above problems and to provide a correction device for an air/fuel ratio sensor which is improved to be able to correct its output properly when an air/fuel ratio sensor is installed on the catalyst downstream.

SUMMARY OF INVENTION

To achieve the above described object, the present invention provides a correction device for an air/fuel ratio sensor that includes:

air/fuel ratio control means for controlling an air/fuel ratio of an exhaust gas on the upstream side from a catalyst installed in an exhaust passage of an internal combustion engine to switch between a rich air/fuel ratio which is richer and a lean air/fuel ratio which is leaner than a stoichiometric air/fuel ratio;

an air/fuel ratio sensor which issues an output according to the air/fuel ratio of an exhaust gas on the downstream from the catalyst of the exhaust passage; and correction coefficient calculating means for calculating a correction coefficient for correcting an output of the air/fuel ratio sensor in accordance with a difference between an output of the air/fuel ratio sensor in a predetermined period during an air/fuel ratio control by the air/fuel ratio control means and during which an output of the air/fuel ratio sensor installed on the downstream from the catalyst is equilibrated and a reference output corresponding to the stoichiometric air/fuel ratio.

In this invention, the predetermined period may be a period from after a first time has elapsed since the air/fuel ratio is switched from the rich air/fuel ratio to the lean air/fuel ratio on the upstream side from the catalyst, by the air/fuel ratio control means, until a second time before the lean air/fuel ratio is switched to the rich air/fuel ratio again, and/or a period from after a third time has elapsed since the lean air/fuel ratio is switched to the rich air/fuel ratio, until a fourth time before the rich air/fuel ratio is switched to the lean air/fuel ratio. Here, the first time to the fourth time may be same time or different time.

Alternatively, the predetermined period may be a period from after a first time has elapsed since the air/fuel ratio is switched from the rich air/fuel ratio to the lean air/fuel ratio on the upstream side from the catalyst, by the air/fuel ratio control means, until a second time before the lean air/fuel ratio is switched to the rich air/fuel ratio. Here, the first and second times may be same time or different time.

Further, the correction device for an air/fuel ratio sensor of this invention may further includes differentiated value calculating means for calculating a differentiated value of a change in an output of the air/fuel ratio sensor. In this case, the predetermined period may be a period during which the differentiated value is within a predetermined allowable range.

Further, in case which uses the differentiated value calculating means, the predetermined period may be a period during which the period in which the differentiated value is within the allowable range continues for a certain time.

Further, the predetermined period may be a period during which the differentiated value is within a predetermined allowable range and a period from after the air/fuel ratio of the air/fuel ratio sensor is switched from the lean air/fuel ratio to the rich air/fuel ratio, until the air/fuel ratio is switched to the lean air/fuel ratio again.

Further, as an output of the air/fuel ratio sensor in each predetermined period, an average value of the output of the air/fuel ratio sensor detected plural times during the predetermined period may be used.

Advantageous Effects of Invention

According to the present invention, if control to switch an air/fuel ratio on the upstream of a catalyst between a rich air/fuel ratio and a lean air/fuel ratio is executed, the catalyst enters an optimally state for purifying during a period after switching of the air/fuel ratio, and an exhaust gas exhausted to downstream side of the catalyst in that state becomes an exhaust gas close to a stoichiometric air/fuel ratio reduced to an optimal state. During such state, an output of the air/fuel ratio sensor is made stable into an output corresponding to the stoichiometric air/fuel ratio and is considered to be equilibrated. Therefore, during a period during which the output of the air/fuel ratio sensor is equilibrated, by comparing an output of the air/fuel ratio sensor and a reference output corresponding to the stoichiometric air/fuel ratio, discrepancy from the reference output of the air/fuel ratio sensor can be obtained. Moreover, by calculating an output correction coefficient of the air/fuel ratio sensor on the basis of this discrepancy, discrepancy caused by deterioration of the air/fuel ratio sensor or the like can be corrected.

Moreover, in the present invention, for those using a period excluding predetermined time before and after the switching of the air/fuel ratio as a predetermined period, an output during a period during which the catalyst enters the optimal state and an output of the air/fuel ratio sensor is made stable can be used more reliably.

Moreover, in the present invention, for those in which a correction coefficient of the air/fuel ratio sensor is obtained on the basis of an output of the air/fuel ratio sensor if a differentiated value of an output change of the air/fuel ratio sensor is within a predetermined allowable range, a noise included in the output of the air/fuel ratio sensor or the like can be removed more reliably, and a more proper output correction coefficient of the air/fuel ratio sensor can be obtained.

Moreover, an oxygen emission speed of the catalyst is easily influenced by a poisoned state or deterioration state, and the influence tends to appear if a rich air/fuel ratio is switched to a lean air/fuel ratio. Therefore, in the present invention, a period when the lean air/fuel ratio is switched to the rich air/fuel ratio is set as a predetermined period, and for those using the output during that period for correction of the air/fuel ratio sensor, correction of the air/fuel ratio sensor can be executed with higher accuracy.

DESCRIPTION OF EMBODIMENTS

Figure 1:
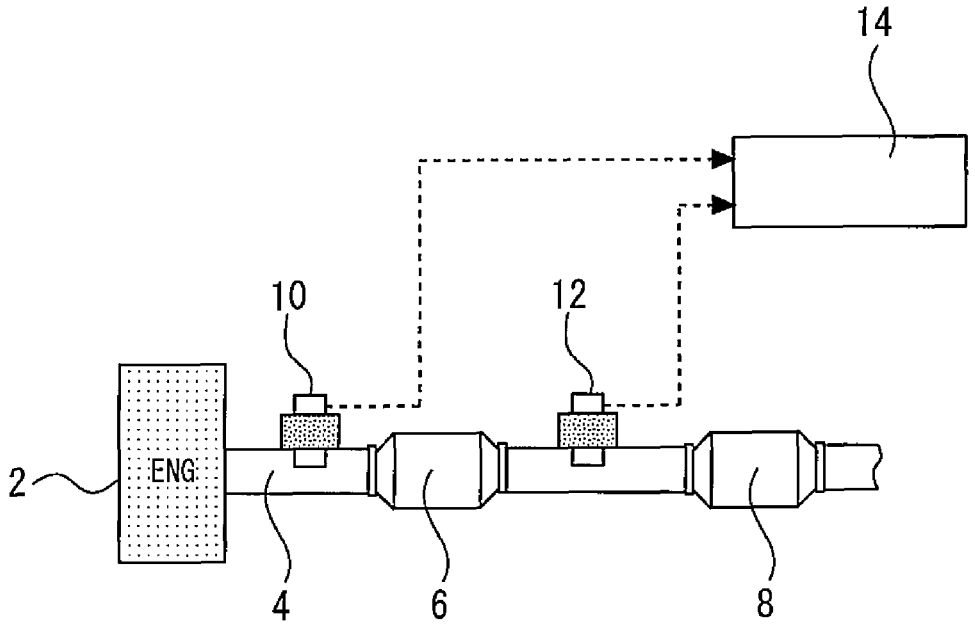
FIG. 1 is a schematic diagram for explaining an entire configuration of a system in Embodiment 1 of the present invention.

Embodiments of the present invention will be described below by referring to the attached drawings. In each figure, the same or equivalent portions are given the same reference numerals and the explanation will be simplified or omitted.

Embodiment 1

FIG. 1 is a schematic diagram for explaining an entire configuration of a system in Embodiment 1 of the present invention. The system in FIG. 1 is mounted on a vehicle or the like and used. In FIG. 1, in an exhaust passage 4 of an internal combustion engine 2, catalysts 6 and 8 are installed. The catalyst 6 can purify an exhaust gas by oxidizing carbon monoxide (CO) and hydrocarbon (HC) exhausted from the internal combustion engine 2 and by reducing nitrogen oxides (NOx).

On the upstream side from the catalyst 6 of the exhaust passage 4, an air/fuel ratio sensor 10 is installed. On the downstream side from the catalyst 6 of the exhaust passage 4 and on the upstream side of the catalyst 8, an air/fuel ratio sensor 12 is installed. The both air/fuel ratio sensors 10 and 12 are limiting-current type sensors and issue an output corresponding to an air/fuel ratio of the exhaust gas to be detected. For convenience, in the following embodiments, the air/fuel ratio sensor 10 on the upstream side of the catalyst 6 is also referred to as an "Fr sensor 10" and the air/fuel ratio sensor 12 on the downstream side as "Rr sensor 12".

The system in FIG. 1 is provided with a controller 14. The controller 14 integrally controls the entire system of the internal combustion engine 2. On the output side of the controller 14, various actuators are connected, while on the input side, various sensors such as the air/fuel ratio sensors 10, 12 and the like are connected. The controller detects various types of information required for operation of the internal combustion engine 2 such as an air/fuel ratio of the exhaust gas, engine revolution speed and others upon reception of sensor signals and also operates each of the actuators in accordance with a predetermined control program. There are a large number of actuators and sensors connected to the controller 14, but the explanation will be omitted in this description. In this system, control executed by the controller 14 includes control for correcting an output of the Rr sensor 12.

Figure 2:
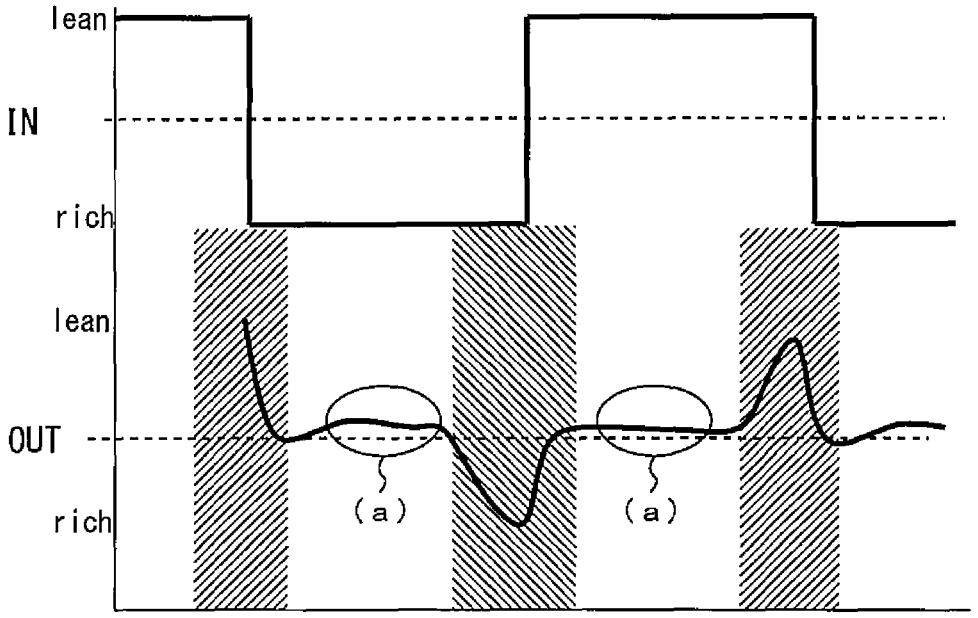
FIG. 2 is a diagram for explaining contents of the control in Embodiment 1 of the present invention.

FIG. 2 is a diagram for explaining contents of the control in Embodiment 1 of the present invention. In FIG. 2, a straight line on the IN side (upper side in the figure)

indicates an air/fuel ratio of the exhaust gas flowing into the catalyst 6, while a curved line on the OUT side (lower side in the figure) indicates an output of the Rr sensor 12 to the exhaust gas flowing out of the catalyst 6.

As illustrated in FIG. 2, the control for correcting the Rr sensor 12 is executed during active control in which an air/fuel ratio of an exhaust gas to be made to flow into the catalyst 6 is fluctuated between a rich air/fuel ratio which is richer and a lean air/fuel ratio which is leaner than a stoichiometric air/fuel ratio. More specifically, in the example in FIG. 2, control of forcedly switching between the rich air/fuel ratio, 14.1 and the lean air/fuel ratio, 15.1 is executed. This active control is control executed for other purposes such as deterioration determination of the catalyst 6 and the like, for example, and is executed on the basis of a control program stored in the controller 14.

In this active control, the air/fuel ratio of the exhaust gas on the IN side flowing into the catalyst 6 is switched from the rich air/fuel ratio to the lean air/fuel ratio and maintained at the lean air/fuel ratio, for example. At this time, the catalyst 6 oxidizes or reduces an unburned component of the exhaust gas in a lean atmosphere and purifies it to an optimal state. The state in which the exhaust gas is purified optimally as above shall be referred to as "optimally purified state". In this optimally purified state, the exhaust gas purified close to the stoichiometric air/fuel ratio is exhausted to the downstream of the catalyst 6. Therefore, as illustrated at (a) in FIG. 2, the Rr sensor 12 stably outputs a value corresponding to the stoichiometric air/fuel ratio.

However, if the lean exhaust gas continuously flows into the catalyst 6, the catalyst 6 stores oxygen to the maximum and enters a state in which oxygen cannot be stored any longer. In this state, the catalyst 6 cannot purify (reduce) a lean component (NOx and the like) any longer and the exhaust gas in a lean atmosphere begins to be exhausted to the downstream of the catalyst 6. Therefore, the output of the Rr sensor 12 becomes a value indicating a predetermined lean air/fuel ratio.

If the output of the Rr sensor 12 becomes a value indicating leanness, the air/fuel ratio of the exhaust gas on the IN side of the catalyst 6 is switched to a rich air/fuel ratio. The rich exhaust gas flows into the catalyst 6, and inside the catalyst 6, equilibration of the gas progresses, and the "optimally purified state" in which the rich exhaust gas is purified to the optimal state is obtained. In this state, the purified exhaust gas close to the stoichiometric air/fuel ratio is exhausted to the downstream side of the catalyst 6. Therefore, as illustrated in FIG. 2(*a*), the output of the Rr sensor 12 is made stable into a value corresponding to the stoichiometric air/fuel ratio from the value indicating leanness.

Subsequently, if the rich exhaust gas continuously flows into the catalyst 6, the catalyst 6 enters a state in which it cannot purify the inflow exhaust gas in a rich atmosphere any longer. In this state, the exhaust gas in the rich atmosphere flows out to the downstream of the catalyst 6. Therefore, the output of the Rr sensor 12 becomes a value indicating the rich atmosphere.

Subsequently, if the air/fuel ratio is switched again to the lean atmosphere, the equilibration of the gas progresses again in the catalyst 6, and a "catalyst optimal state" in which the exhaust gas is purified to the optimal state is obtained. In this state, the output of the Rr sensor 12 is made stable again to a value corresponding to the stoichiometric air/fuel ratio.

During the active control, the above described rich air/fuel ratio and lean air/fuel ratio are repeatedly switched. If the catalyst enters the optimally purified state for a certain period after the switching, the output of the Rr sensor 12 also indicates a value close to the stoichiometric air/fuel ratio stably. Here, the output of the Rr sensor 12 in the optimally purified state theoretically indicates a reference output (14.6) which is an output corresponding to the stoichiometric air/fuel ratio.

However, even in the optimally purified state, an output value of the Rr sensor 12 might not become a value corresponding to the stoichiometric air/fuel ratio due to deterioration over time of the Fr sensor 10 or the Rr sensor 12, initial variation and the like. The discrepancy between the sensor output and the reference output in the optimally purified state is considered to be discrepancy over the entire output of the Rr sensor 12.

As described above, in this Embodiment 1, the output of the Rr sensor 12 in the optimally purified state during the active control is detected, a difference between an output detected value and the reference output (14.6) is acquired, and an average value of this difference is calculated. This average value is used as an output correction coefficient for the Rr sensor 12.

However, it takes some time after the air/fuel ratio is switched from the rich air/fuel ratio to the lean air/fuel ratio or from the lean air/fuel ratio to the rich air/fuel ratio until the Rr sensor 12 issues a stable output. Therefore, in this Embodiment 1, a period from 2 seconds after the switching to the rich air/fuel ratio to 2 seconds before the switching to the lean air/fuel ratio and a period from 2 seconds after the switching to the lean air/fuel ratio to 2 seconds before the switching to the rich air/fuel ratio are set as catalyst optimal states, and the output of the Rr sensor 12 during these periods is detected, and a correction coefficient is calculated.

Figure 3:
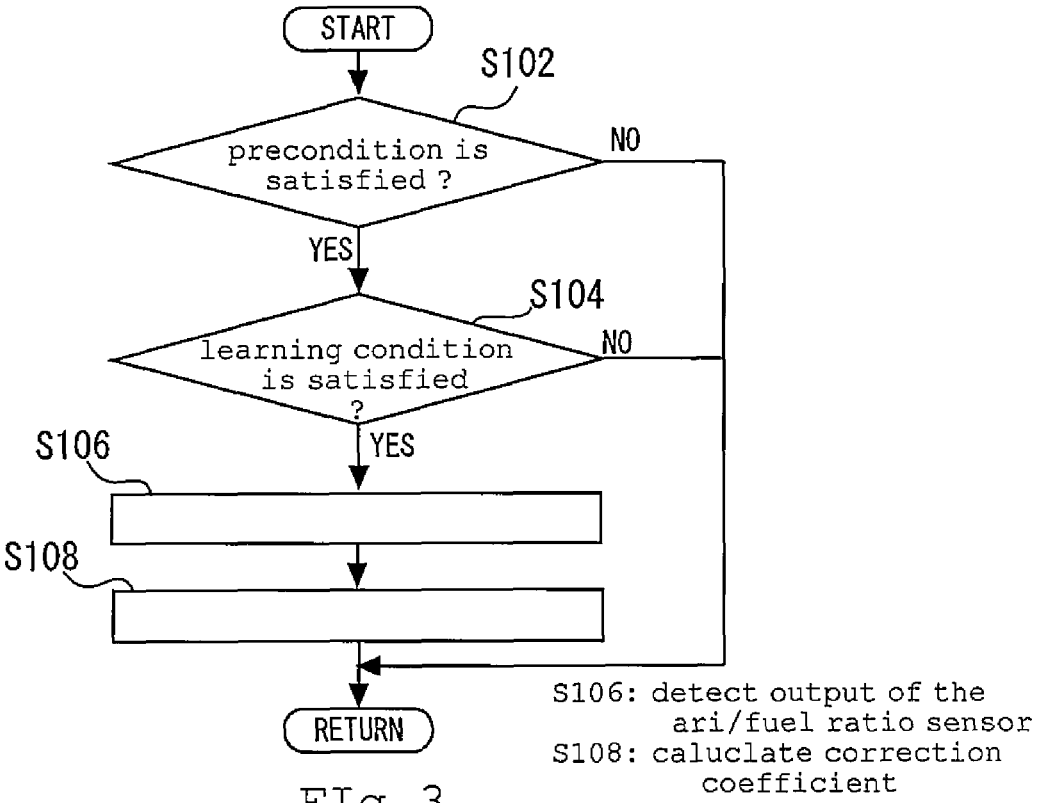
FIG. 3 is a flowchart for explaining a control routine executed by the controller in Embodiment 1 of the present invention.

FIG. 3 is a flowchart for explaining a control routine executed by the controller in Embodiment 1 of the present invention. In the control in FIG. 3, first, it is determined whether or not a precondition is satisfied (S102). The precondition here is whether or not an operation condition is capable of active control, whether or not it is during the active control or the like, and shall be set in advance and stored in the controller 14. If the precondition is not found to be satisfied at Step S102, the processing this time is finished.

On the other hand, if the precondition is found to be satisfied at Step S102, then, it is determined whether a learning condition is satisfied or not (S104). Here, the learning condition is, for example, whether or not the catalyst 6 is in an active state, whether or not the downstream side of the catalyst 6 is fluctuated between a predetermined rich air/fuel ratio and lean air/fuel ratio and the like, and shall be set in advance and stored in the controller 14. If the learning condition is not found to be satisfied at Step S104, the processing this time is finished for the moment.

On the other hand, if the learning condition is found to be established at Step S104, the air/fuel ratio in the optimally purified state is detected (S106). Specifically, in this Embodiment 1, a period during the active control and from which 2 seconds before and after the switching of the air/fuel ratio from the rich air/fuel ratio to the lean air/fuel ratio or from the lean air/fuel ratio to the rich air/fuel ratio are excluded is set as the optimally purified state. At Step S106, the output of the Rr sensor 12 during this period is repeatedly detected at every predetermined time until a predetermined number of samples is reached.

Subsequently, the correction coefficient is calculated (S108). In calculation of the correction coefficient, first, a difference between the output of the Rr sensor 12 detected at Step S106 and the reference output (14.6) is obtained. After that, an average value of this difference is calculated, and this average value is set as the correction coefficient. Subsequently, the processing this time is finished for the moment.

The calculated average value (correction coefficient) is used as a learned value for the optimally purified states of the Fr sensor 10 and the Rr sensor 12. For example, in feedback control of the air/fuel ratio using the air/fuel ratio sensors 10 and 12, a value (reference value) with respect to the stoichiometric air/fuel ratio to be a reference of the output is corrected as in the following formula (1):

$$\text{Reference value} = 14.6 + \text{correction coefficient} + \text{other learned values} \quad (1)$$

As described above, by executing correction on the basis of the sensor output in the optimally purified state, without being affected by discrepancy of a purification point caused by deterioration of the catalyst 6, discrepancy of the stoichiometric air/fuel ratio caused by a change in the fuel, output discrepancy of the sensor due to an increase in a rich gas and the like, the outputs of the air/fuel ratio sensors 10 and 12 with respect to the optimally purified point of the catalyst 6 can be corrected, and control based on the optimally purified state can be executed.

In this Embodiment 1, execution of the control for calculating the correction coefficient of the air/fuel ratio sensors 10 and 12 during the active control regardless of an operation region was explained. However, the present invention is not limited to that. An intake air amount largely affects catalyst purification performances. In order to handle such elements, it may be so configured that an engine revolution speed is divided into several regions and the correction coefficient is calculated for each region. As a result, the outputs of the air/fuel ratio sensors 10 and 12 can be corrected with higher accuracy. This also applies to Embodiment 2.

Moreover, in this Embodiment 1, execution of the control for calculating the correction coefficient of the air/fuel ratio sensors 10 and 12 in this Embodiment 1 by using timing during execution of the active control which is a control for the other purposes such as deterioration determination of the catalyst 6 and the like was explained. By using this, the correction coefficient can be calculated efficiently. However, the present invention is not limited to that, and the active control may be executed separately for calculating the correction coefficient of the air/fuel ratio sensors 10 and 12. This also applies to Embodiment 2.

Moreover, in Embodiment 1, in both the cases in which the rich air/fuel ratio is switched to the lean air/fuel ratio and the lean air/fuel ratio is switched to the rich air/fuel ratio, the case in which the output of the Rr sensor 12 is detected and used for calculation of the correction coefficient was explained. However, in the catalyst 6, an oxygen emission speed can easily change depending on the deterioration state or poisoned state. And the influence can easily appear when the air/fuel ratio is changed from rich to lean. Therefore, it may be so configured that the correction coefficient is calculated by using only the output when the lean air/fuel ratio is switched to the rich air/fuel ratio in calculation of the correction coefficient of the Rr sensor 12 in the present invention. As a result, more proper correction coefficient can be obtained. This also applies to Embodiment 2.

Moreover, in this Embodiment 1, the case in which the limiting current type air/fuel ratio sensors 10 and 12 are arranged on the upstream and the downstream of the catalyst 6, respectively, was explained. However, in the present invention, the air/fuel ratio sensor 10 on the upstream side is not limited to that. The upstream-side sensor of the catalyst 6 is used for controlling the air/fuel ratio on the upstream of the catalyst 6 in the active control to a predetermined rich air/fuel ratio and lean air/fuel ratio. Therefore, in the present invention, another sensor capable of detecting an air/fuel ratio on the upstream side of the catalyst 6 can be used instead of the air/fuel ratio sensor 10. Moreover, the present invention is not limited to that in which a sensor for air/fuel ratio detection is arranged on the upstream of the catalyst 6 of the exhaust passage 4. For example, the air/fuel ratio may be detected in accordance with an output of an in-cylinder pressure sensor installed in the internal combustion engine 2 without installing the air/fuel ratio sensor 10. This also applies to Embodiment 2.

Moreover, in this Embodiment 1, the case in which an average value of the difference between the output of the Rr sensor 12 and the reference output is used as the correction coefficient of the air/fuel ratio sensors 10 and 12 was explained. However, in the present invention, the calculation method of the correction coefficient for the air/fuel ratio sensors 10 and 12 is not limited to that and any method can be used as long as it is detected by another method in accordance with a difference from the reference output. Moreover, the case in which the output of the Rr sensor 12 is detected plural times and the average value of them is used was explained, but the present invention is not limited to that, and one detected value may be used for calculation of the correction coefficient as it is. This also applies to Embodiment 2.

Moreover, the present invention is not limited to the case in which the correction coefficient for correcting both the air/fuel ratio sensors 10 and 12 is acquired, but a correction coefficient for correcting only the output of the air/fuel ratio sensor 12 may be acquired, for example. This also applies to Embodiment 2.

For example, in the Embodiment 1, the period during the active control and from which 2 seconds before and after the switching of the air/fuel ratio from the rich air/fuel ratio to the lean air/fuel ratio or from the lean air/fuel ratio to the rich air/fuel ratio are excluded corresponds to the "predetermined period during which the output of the air/fuel ratio sensor is equilibrated" in the present invention. By means of execution of Steps S106 and S108 in this Embodiment 1, the "correction coefficient calculating means" in the present invention is realized.

Embodiment 2

Embodiment 2 has a configuration similar to that of the system in FIG. 1. Moreover, the system in Embodiment 2 executes control similar to that of the system in Embodiment except that a different period is specified as the predetermined period during which the output of the Rr sensor 12 is equilibrated. That is, in the system of the Embodiment 2, too, the output of the Rr sensor 12 in the optimally purified state is detected, and the correction coefficient is calculated on the basis of this output value. However, in Embodiment 2, only the output of the case in which a differentiated value of the output change is a predetermined value or less is used, and the correction coefficient is calculated on the basis of this output.

Figure 4:
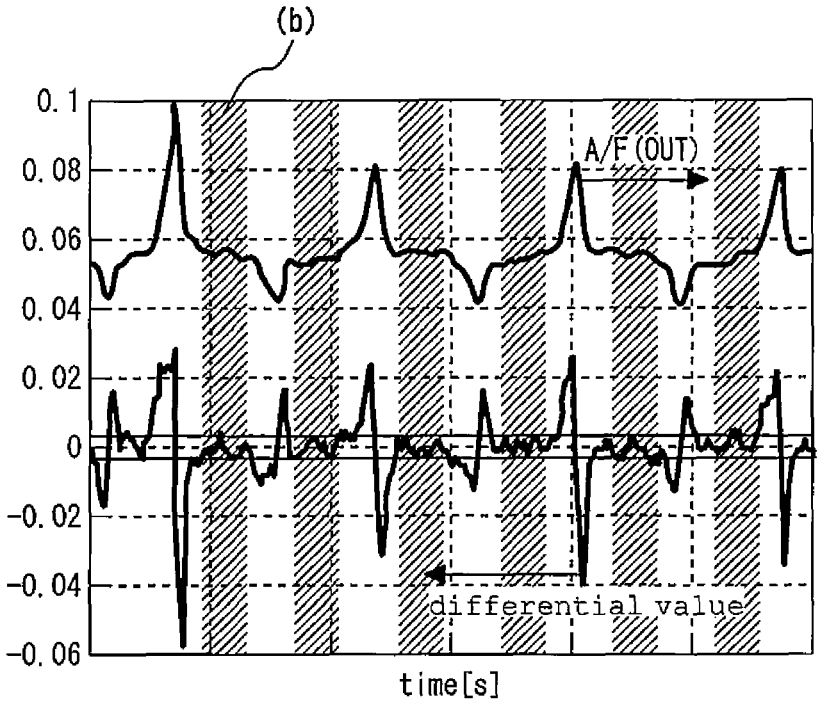
FIG. 4 is a diagram for explaining contents of the control in Embodiment 2 of the present invention.

FIG. 4 is a diagram illustrating the output of the Rr sensor 12 and its differentiated value. Moreover, an upper curve in FIG. 4 is an output of the Rr sensor 12, while a lower curve indicates a value obtained by differentiating the output change of the Rr sensor 12. Moreover, in FIG. 4, a shaded portion indicated by (b) is the optimally purified state.

As illustrated in FIG. 4, when the air/fuel ratio of an exhaust gas on the downstream of the catalyst is largely changed from the rich air/fuel ratio to the lean air/fuel ratio or to the contrary, it is confirmed that its differentiated value also increases. Moreover, in the optimally purified state, the differentiated value also shows a stable value. However, the output of the Rr sensor might include a noise, and in this case, the differentiated value largely changes in the optimally purified state, too.

Therefore, in Embodiment 2, a differential width for the noise is acquired in advance by an experiment or the like, and an allowable differential width (allowable range) is determined. If the differentiated value is contained in this allowable range, the output of the Rr sensor 12 is used for calculation of the correction coefficient. A calculating method and a correcting method of the correction coefficient are similar to those in Embodiment 1, and an average value of a difference between the output and the stoichiometric air/fuel ratio 14.6 is acquired, and this is used as the correction coefficient.

As described above, by using only the output of a period during which the differentiated value is contained in the allowable range as an output in calculation of the correction coefficient, a noise included in the output of the Rr sensor 12 can be cut. As a result, more proper correction coefficient can be calculated, and accuracy of the air/fuel ratio control and the like can be improved.

In this Embodiment 2, the period during which the differentiated value is contained in the allowable range corresponds to the "predetermined period during which the output of the air/fuel ratio sensor is equilibrated" of the present invention. In this second Embodiment 2, the case in which the output of the Rr sensor 12 is used for calculation of the sensor output correction coefficient in this period was explained. However, in the present invention, the "predetermined period during which the output of the air/fuel ratio sensor is equilibrated" is not limited to this. For example, it may be so configured that only the period during which the period in which the differentiated value is contained in the allowable range continues for a certain time is set as the "predetermined period" of the present invention, and only the output in this period is used for calculation of the correction coefficient.

In the above embodiments, when the number, quantity, amount, range and the like of each element are referred to, the present invention is not limited to the referred number except when particularly explicitly indicated or obviously specified to the number in principle. Moreover, the structures or the like explained in these embodiments are not necessarily indispensable to the present invention except when particularly explicitly indicated or obviously specified therefor in principle.

2 internal combustion engine
6, 8 catalysts
10 air/fuel ratio sensor (Fr sensor)
12 air/fuel ratio sensors (Rr sensor)
14 controller

What is claimed is:

1. A correction device for an air/fuel ratio sensor comprising:

a catalyst installed in an exhaust passage of an internal combustion engine;

an air/fuel ratio sensor installed on the downstream side from the catalyst of the exhaust passage and issuing an output according to the air/fuel ratio of an exhaust gas;

air/fuel ratio control means for controlling an air/fuel ratio of an exhaust gas on the upstream side from the catalyst to switch between a rich air/fuel ratio which is richer and a lean air/fuel ratio which is leaner than a stoichiometric air/fuel ratio;

correction means for correcting an output of the air/fuel ratio sensor in accordance with a difference between an output of the air/fuel ratio sensor in a predetermined period during an air/fuel ratio control by the air/fuel ratio control means and a reference output corresponding to the stoichiometric air/fuel ratio, wherein the predetermined period is a period only after the air/fuel ratio is switched from the lean air/fuel ratio to the rich air/fuel ratio and a period during the output of the air/fuel ratio sensor is equilibrated.

2. The correction device for an air/fuel ratio sensor according to claim 1, wherein the predetermined period is a period from after a first time has elapsed since the lean air/fuel ratio is switched to the rich air/fuel ratio, until a second time before the rich air/fuel ratio is switched to the lean air/fuel ratio.

3. The correction device for an air/fuel ratio sensor according to claim 1, further comprising:

differentiated value calculating means for calculating a differentiated value of a change in an output of the air/fuel ratio sensor, wherein the predetermined period is a period during which the differentiated value is within a predetermined allowable range.

4. The correction device for an air/fuel ratio sensor according to claim 3, wherein the predetermined period is a period during which the period in which the differentiated value is within the allowable range continues for a certain time.

5. The correction device for an air/fuel ratio sensor according to claim 1, wherein as an output of the air/fuel ratio sensor in the predetermined period, an average value of the output of the air/fuel ratio sensor detected plural times during the predetermined period is used.

6. The correction device for an air/fuel ratio sensor according to claim 1, wherein the predetermined period is a period during the catalyst is in a optimally purified state which a rich or lean exhaust gas flowing into the catalyst purified close to stoichiometric air/fuel ratio.

7. The correction device for an air/fuel ratio sensor according to claim 1, wherein the correction means is arranged to correct the output of the air/fuel ratio sensor for each of several regions into which the engine speed of the internal combustion engine is divided.

8. A correction device for an air/fuel ratio sensor comprising:

a catalyst installed in an exhaust passage of an internal combustion engine and having oxygen storage capacity;

an air/fuel ratio sensor installed on the downstream side from the catalyst of the exhaust passage and issuing an output according to the air/fuel ratio of an exhaust gas; and a controller that is programmed to:

control an air/fuel ratio of an exhaust gas on the upstream side from the catalyst to switch between a rich air/fuel ratio which is richer and a lean air/fuel ratio which is leaner than a stoichiometric air/fuel ratio; and correct an output of the air/fuel ratio sensor in accordance with a difference between an output of the air/fuel ratio sensor in a predetermined period during an air/fuel ratio of an exhaust gas on the upstream side from the catalyst is controlled to switch between the rich or the lean air/fuel ratio and a reference output corresponding to the stoichiometric air/fuel ratio, wherein the predetermined period is a period only after the air/fuel ratio is switched from the lean air/fuel ratio to the rich air/fuel ratio and a period during an output of the air/fuel ratio sensor is equilibrated.

9. The correction device for an air/fuel ratio sensor according to claim 8, wherein the predetermined period is a period during the catalyst is in a optimally purified state which a rich or lean exhaust gas flowing into the catalyst purified close to stoichiometric air/fuel ratio.

* * * * *